US009926677B1

(12) United States Patent
Beckhusen et al.

(10) Patent No.: US 9,926,677 B1
(45) Date of Patent: Mar. 27, 2018

(54) CONSTANT DOWN FORCE VIBRATORY COMPACTOR

(71) Applicant: Caterpillar Inc., Peoria, IL (US)

(72) Inventors: Jordan R. Beckhusen, Waco, TX (US); Ryan Rochel, China Spring, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/276,137

(22) Filed: Sep. 26, 2016

(51) Int. Cl.
*E01C 19/38* (2006.01)
*E02D 3/046* (2006.01)

(52) U.S. Cl.
CPC ..... *E01C 19/38* (2013.01); *E02D 3/046* (2013.01)

(58) Field of Classification Search
CPC ..... E01C 19/38; E02D 3/046
USPC ..... 404/113, 114, 117–120, 133.05–133.2, 404/72, 75
See application file for complete search history.

(56) References Cited

U.S. PATENT DOCUMENTS 3,427,939 A 2/1969 Braff et al.
3,561,336 A 2/1971 Century
3,909,149 A * 9/1975 Century ..... E02D 3/074 173/162.1
3,917,426 A * 11/1975 Wohlwend ..... B06B 1/16 404/113
4,043,694 A 8/1977 Mullen
4,224,003 A * 9/1980 St. Louis ..... E02D 3/046 37/904
4,388,018 A * 6/1983 Boschung ..... E02D 3/046 404/113
4,439,057 A * 3/1984 Sprague ..... E02D 3/046 173/205
4,698,926 A * 10/1987 Caplis ..... E01C 19/38 37/195
4,735,523 A * 4/1988 Ishikawa ..... E02D 3/074 212/349
4,790,687 A * 12/1988 Wright ..... E02D 3/046 37/367
4,826,359 A * 5/1989 Bec ..... E02L 33/12 37/105

(Continued)

FOREIGN PATENT DOCUMENTS

DE 1039951 B 9/1958
EP 2258902 A2 12/2010

*Primary Examiner* — Raymond W Addie
(74) *Attorney, Agent, or Firm* — Leydig, Voit & Mayer, Ltd.

(57) ABSTRACT

A vibratory compactor for a work machine, includes a support frame that defines an interior space and includes a base disposed at a lower end thereof configured to contact a work surface. A guide member is attached to the support frame. A vibratory mechanism includes a vibratory housing and includes a contact plate. The contact plate is configured to compact the work surface. An excitation device is configured to vibrate the contact plate. A guide opening is formed through the vibratory housing configured to movably receive the guide member and to permit the vibratory mechanism vertical movement relative to the support frame. At least one biasing member is disposed between the support frame and the vibratory housing and generates a selected force between the support frame and the vibratory housing when the base is in contact with the work surface.

20 Claims, 6 Drawing Sheets

(56) References Cited

U.S. PATENT DOCUMENTS

| | | | | | |
|---|---|---|---|---|---|
| 4,966,499 | A * | 10/1990 | St Louis | E02D 3/02 | 37/904 |
| 5,220,845 | A * | 6/1993 | Anderson | E02D 3/02 | 184/13.1 |
| 5,713,418 | A * | 2/1998 | Warren | E01C 19/38 | 172/40 |
| 7,908,084 | B2 | 3/2011 | Anderegg et al. | | |
| 8,057,124 | B2 | 11/2011 | Stenzel et al. | | |
| 2011/0013982 | A1* | 1/2011 | Prohaska | E02D 3/046 | 404/72 |

* cited by examiner

CONSTANT DOWN FORCE VIBRATORY COMPACTOR

TECHNICAL FIELD

This disclosure relates generally to vibratory compactors and work machines with vibratory compactors.

BACKGROUND

Various work machines such as excavators, backhoes, skid steer loaders, or other like machines can be fitted with a type of work tool referred to as a vibratory compactor. Vibratory compactors may include a plate or roller that is oscillated or vibrated to impose compaction forces on a work surface including densifiable strata, such as ground soil, roadway base material, paving material, or other work surface. In some instances, an engine or hydraulic motor controllably rotates at least one eccentric mass to impart vibratory motion at a particular frequency to the surface contacting plate or roller member. The result is an oscillatory force with the frequency of the speed of rotation, and an amplitude dependent on the mass eccentricity and speed of rotation. Variations on this basic system include multiple eccentric weights and/or shafts such that by changing the phasing of the multiple weights and/or shafts, the degree of force created by the eccentric masses can be varied.

The application of down force with a vibratory plate compactor attached to a boom of a work machine is an important parameter of efficient compaction operation. Vibratory plate compactors are solely reliant on the work machine for the generation of static down force. However, down force changes throughout the range of motion of the work machine boom and stick. While static down force is a simple matter to generate, the force varies dependent upon the boom geometry relative to the machine. The consistent production of static down force in a vibratory plate compactor can be difficult to accomplish given the configurations of many such devices.

The disclosed system is directed to overcoming one or more of the problems set forth above and/or other problems of the prior art.

SUMMARY

The present disclosure is generally directed in one aspect, to a vibratory compactor, including a support frame that defines an interior space and includes a base disposed at a lower end thereof configured to contact a work surface. A guide member is attached to the support frame. A vibratory mechanism includes a vibratory housing and includes a contact plate disposed on the vibratory housing. The contact plate is configured to compact the work surface. One or more excitation devices is configured to vibrate the contact plate. A guide opening is formed through the vibratory housing and is configured to movably receive the guide member and configured to permit the vibratory mechanism vertical movement relative to the support frame. At least one biasing member is disposed between the support frame and the vibratory housing and generates a selected force between the support frame and the vibratory housing when the base of the support frame is in contact with the work surface.

Further, an aspect of the disclosure includes a method of operating a vibratory compactor wherein a vibratory mechanism of the vibratory compactor is brought into contact with a work surface. A support frame of the vibratory compactor is brought into contact with the work surface. A biasing member generates a selected down force between the support frame and the vibratory housing and a fluctuating vertical force is generated with the vibratory mechanism that in combination with the selected down force, causes compaction of the work surface.

DETAILED DESCRIPTION

Figure 1:
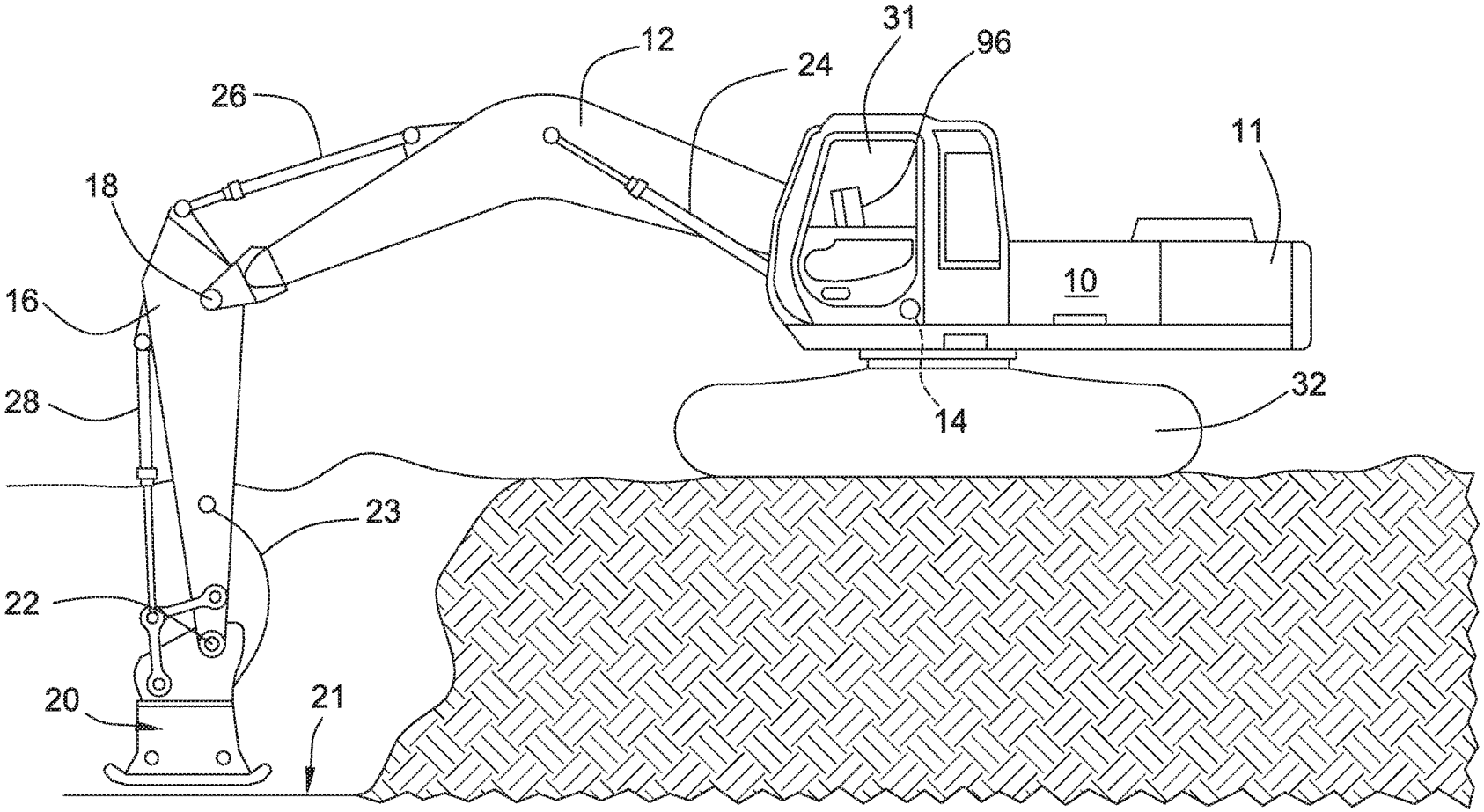
FIG. 1 is a diagram of a work machine and vibratory plate compactor.

FIG. 1 illustrates a work machine 10, which may be an excavator, incorporating an embodiment of the disclosure. The work machine includes a chassis 11, a boom 12 pivotally secured to the chassis 11 at a first pivot joint 14, a stick 16 pivotally secured to the boom 12 at a second pivot joint 18, and a vibratory plate compactor 20 pivotally secured to the stick 16 at a third pivot joint 22. First, second and third hydraulic devices, comprising first, second, and third hydraulic cylinders 24, 26, and 28, are provided to move the boom 12, stick 16, and vibratory compactor 20. Vibratory plate compactor 20 is supplied with hydraulic and/or electrical power 23 as is well known. The vibratory plate compactor 20 is shown disposed near or on a work surface 21.

The chassis 11 carries an operator cab 31. The cab 31 is supported on an undercarriage support and transport 32, which may include track belts that facilitate the movement of the work machine 10 over a worksite. The chassis 11 and the components it carries can be rotated about a generally vertical axis by any well known mechanism, with respect to the undercarriage support and transport 32 to place the vibratory compactor 20 at the precise location needed for operation. It should be appreciated that although the embodiment is shown with a one-piece boom, it is also applicable to any work machine having the capability of connecting to and operating a vibratory compactor including work machines with variable angle booms and other attachment and control mechanisms.

Figure 2:
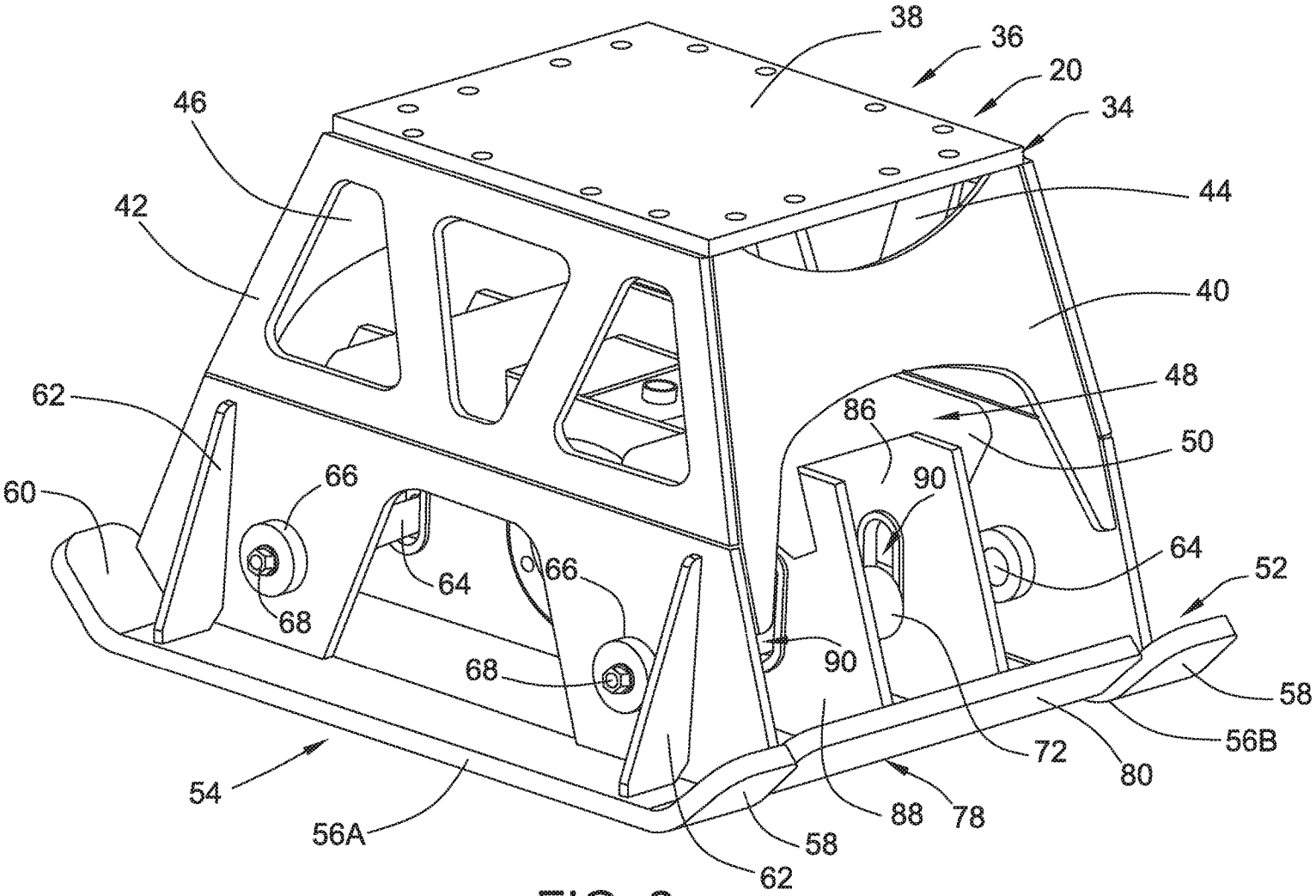
FIG. 2 is a perspective view of a vibratory plate compactor according to an embodiment of the disclosure.
Figure 3:
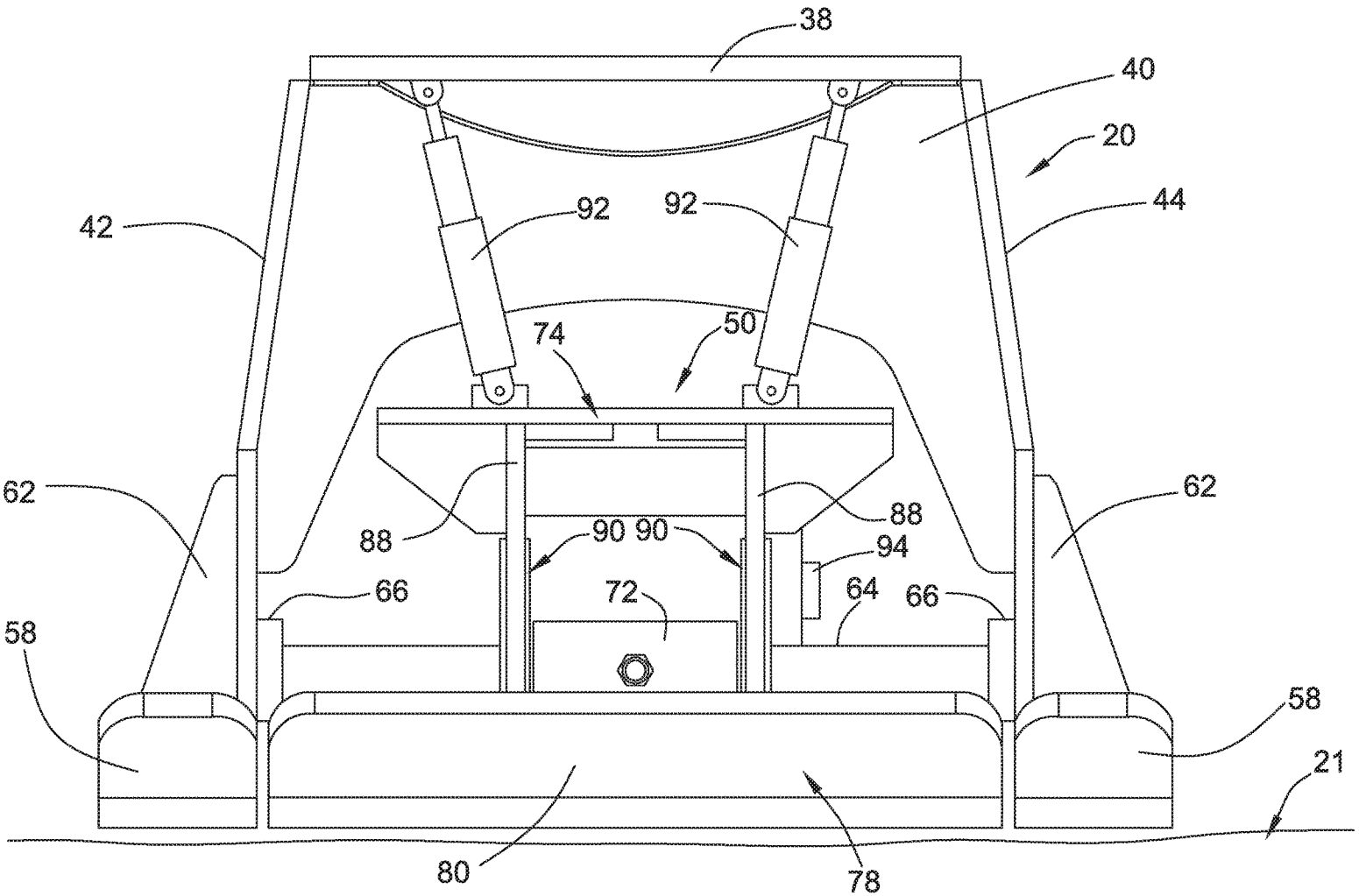
FIG. 3 is a cutaway rear view of the vibratory plate compactor of FIG. 2.
Figure 4:
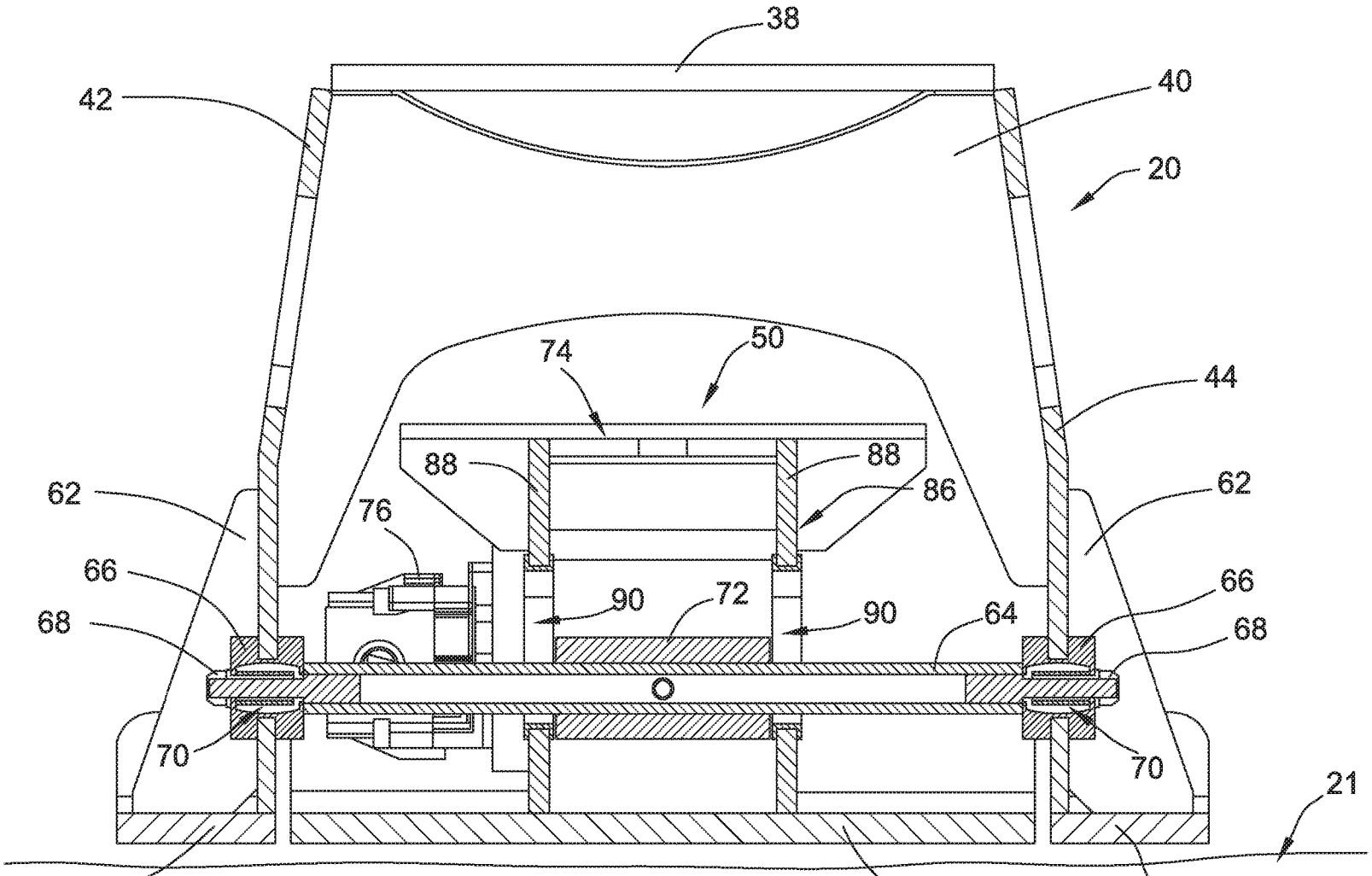
FIG. 4 is a cross section view of the vibratory plate compactor of FIG. 2 through one of the guide rods.
Figure 5:
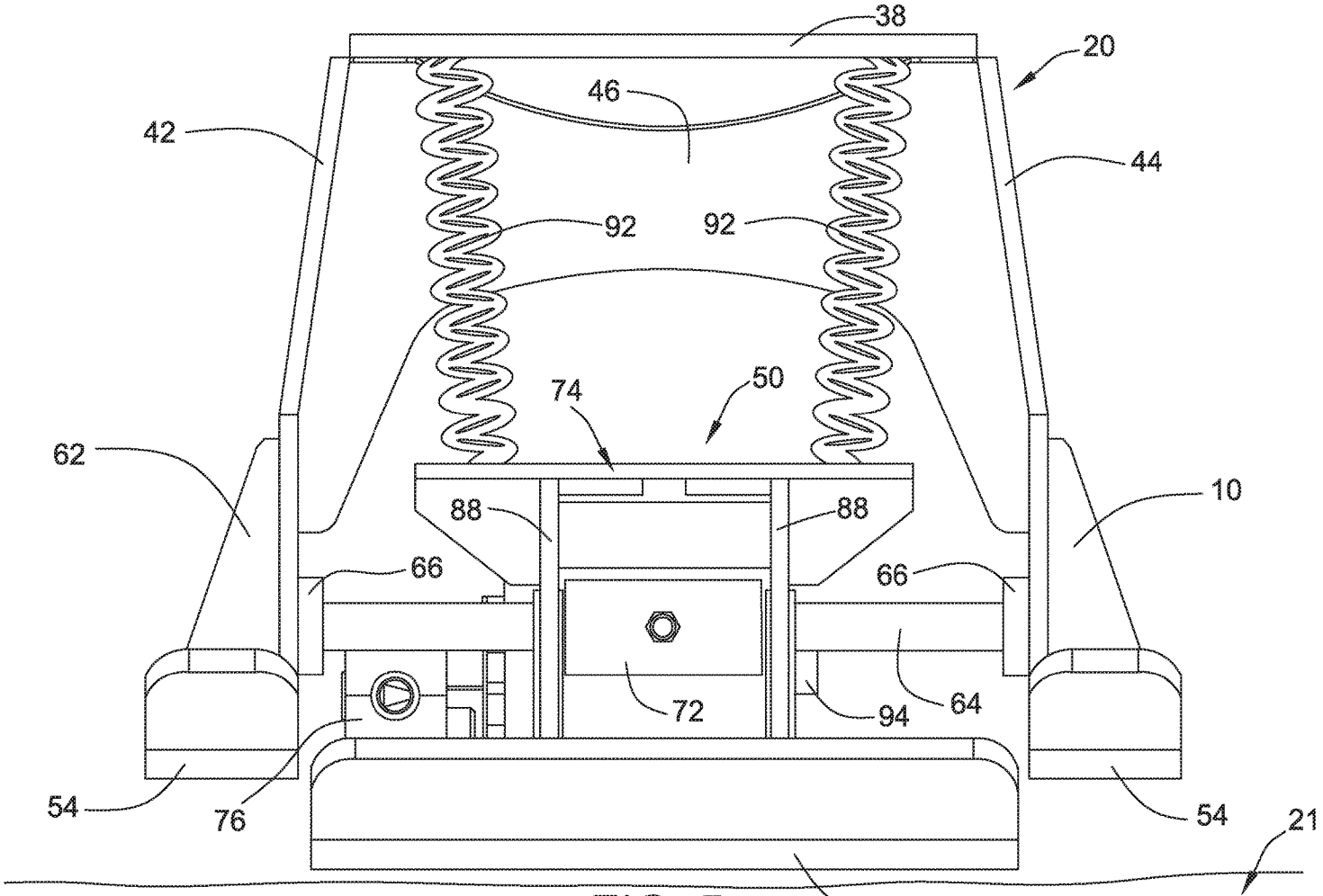
FIG. 5 is a cutaway rear view of the vibratory plate compactor of FIG. 2 not in contact with a work surface.
Figure 6:
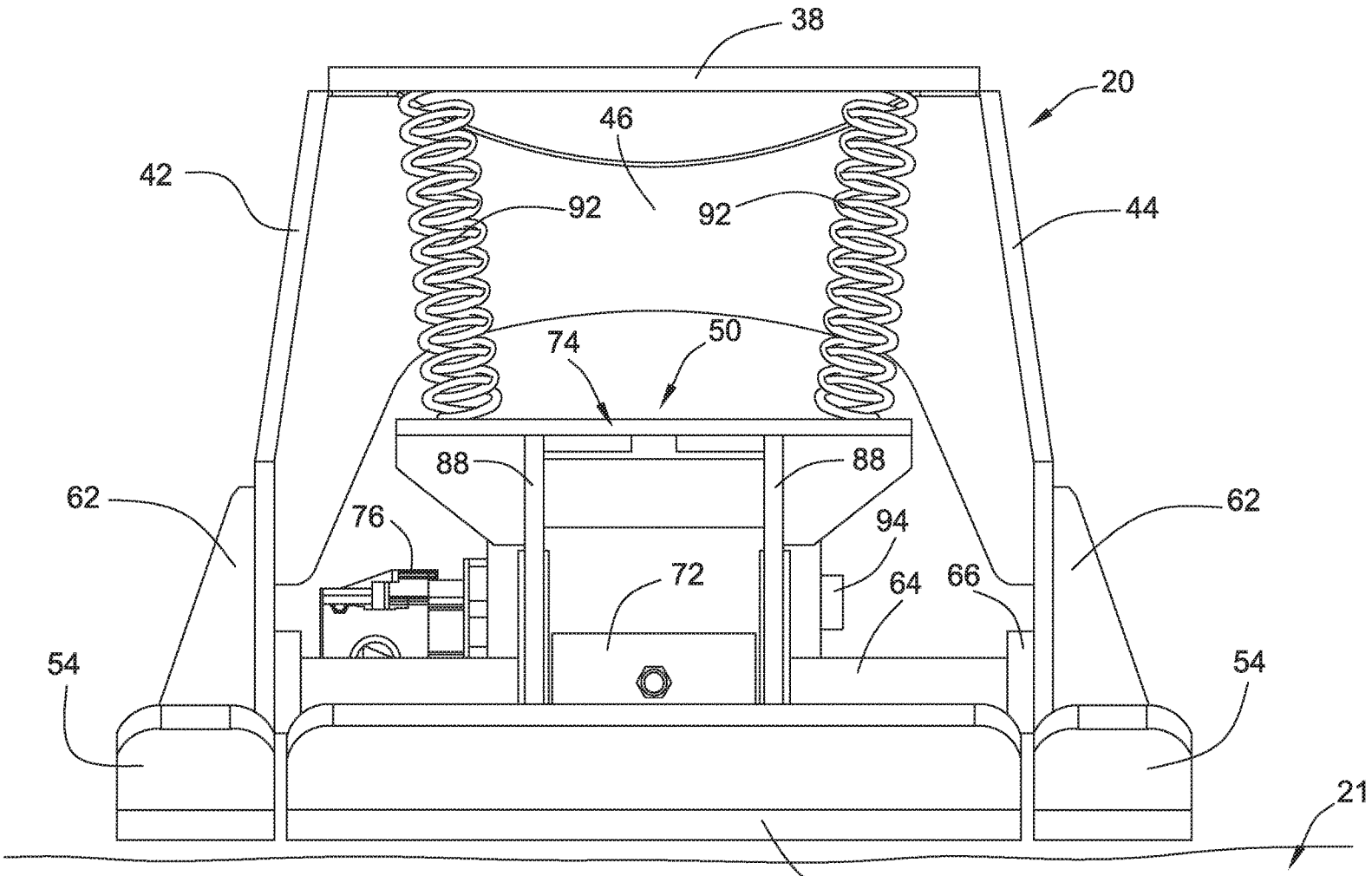
FIG. 6 is a cutaway rear view of the vibratory plate compactor of FIG. 2 in contact with a work surface.

FIGS. 2-4 illustrate a vibratory plate compactor 20 according to the disclosure. FIGS. 5 and 6 illustrate embodiments of the disclosure in use in a non-deployed and a deployed state respectively. Referring to the figures, the vibratory plate compactor 20 includes a support frame or skid 34. The support frame 34 may be formed of any suitable material, such as steel, cast iron, aluminum, and fiber-reinforced plastic.

The support frame 34 includes an upper end 36 including a top plate 38, which may be square, rectangular, or any suitable shape. The top plate 38 may be constructed with elements (not shown), as is well known, such as a top bracket or hinge plates, to attach the vibratory plate compactor 20 directly to a work machine 10.

The support frame 34 may include four sides attached to the top plate 38 via any suitable attachment method, such as welding or fasteners. The four sides may include a front panel 40, first and second side panels 42, 44 disposed opposite each other in a spaced apart configuration, and a rear panel 46 opposite the front panel in a spaced apart configuration. The top plate 38 and panels 40, 42, 44, 46 may be solid plates or elements or alternatively, may have cut-out sections to reduce the weight of the support frame 34. The panels 40, 42, 44, 46 may be square, rectangular, trapezoidal, for example, and may be formed of single or multiple sub-panel sized and shaped parts. The panels 40, 42, 44, 46 may be formed and not flat.

The assembly of the top plate 38 and panels 40, 42, 44, 46 may define an interior space or enclosure 48 that is rectangular, cube-shaped, or a truncated rectangular pyramid, for example. Other suitable enclosure shapes are contemplated. The interior space 48 is shaped and sized to enclose and support a vibratory mechanism 50 and other mechanisms as will detailed herein.

A skid base 54 is disposed at a lower, ground-contacting end 52 of the support frame 34. The skid base 54 may include skids 56*a*, 56*b*. Each of the skids 56*a*, 56*b* is disposed on a respective one of the first and second side panels 42, 44, at the lower end 52 of the support frame 34. Each of the skids 56*a*, 56*b* may in the shape of a ski, with an upturned front end 58. Optionally, each of the skids 56*a*, 56*b* may include an upturned rear end 60. The upturned ends 58, 60 support the movement of the support frame 34 over the work surface.

In an alternate embodiment, the skid base 54 may surround the entire periphery of the lower end 52 of the support frame 34. Other mechanisms may be provided to support the movement of the support frame 34 over a work surface 21, such as rollers or wheels. Also, the first and second side panels 42, 44, may include one or more gusset 62 to reinforce the attachment of each skid 56*a*, 56*b* to a respective one of the first and second side panels.

The illustrated embodiment includes spaced guide members 64 connecting to the first and second side panels 42, 44 and extending through and across the interior space 48. The guide members 64 may be rod shaped or other longitudinally extending shapes. The guide members 64 may be secured to the first and second side panels 42, 44 including by a resilient member 66, such as a bushing, disposed in openings 70 (FIG. 4) formed through the first and second side panels. Each end of each guide member 64 may be secured in position with a guide member fastener 68, which may be a bolt threaded into each end of the guide member and a washer, or other retaining element such as an adhesive, weld, machined in retainer mechanism or the like. In one embodiment, a first one of the spaced guide members 64 extends horizontally across the interior space 48 adjacent the front panel 40 and a second one of the spaced guide members extends parallel to the first one adjacent the rear panel 46 and adjacent the lower end 52 of the support frame 34. FIGS. 3, 4, 5, and 6 also show that each of spaced guide members 64 may include a mid-section 72 having a larger dimension, relative to outboard section of the guide members, which functions to maintain the position of the vibratory mechanism 50 within the interior space 48. The mid-section 72 may be round or other shapes. Other structures or elements are contemplated to maintain position of the vibratory mechanism 50, such as fasteners, clips, pins, and so on, on the guide members.

Vibratory mechanism 50 is disposed, at least in part, in the interior space 48. It should be understood that the size and shape of the interior space 48 is sufficiently large to accommodate the vibratory mechanism 50 and a number of associated mechanisms, which will be detailed herein, during operation of the mechanism and when not in operation.

The vibratory mechanism 50 includes a vibratory housing 74, which may be an enclosure, a framework or a similar support structure or assembly. The vibratory housing 74 may include an excitation device, as is well known, such as an eccentric weight or shaft (not shown) that is driven by a motor or pump 76 (FIGS. 4, 5, and 6) attached to or in operative communication with the vibratory housing 74.

The vibratory mechanism 50 includes a vibratory base 78 that is sized, shaped and positioned to contact and operate on the work surface 21 (FIG. 1). The vibratory base 78 may be a separate part attached to the vibratory housing 74 or formed as a single piece construction therewith. The vibratory base 78 is formed of any suitable material, such as steel, to compact the work surface and resist wear and damage from exposure to harsh operating conditions. In one embodiment, the vibratory base 78 is plate, shoe or ski shaped with an optional upturned front and rear end 80, 82 and a substantially flat mid-section 84.

The vibratory housing 74 at front and rear portions thereof may include vibratory housing mounting brackets 86. Each of the mounting brackets 86 may include one or more bracket gusset 88, each including a guide opening 90, which may be in the form of a vertical slot. The mounting brackets 86 may interconnect the vibratory housing 74 and the base 78 and provide reinforcement. The guide openings 90 are each shaped and sized to receive one of the guide members 64 and permit the vibratory housing 74 to move vertically up and down relative to the support frame 34 since the guide members are substantially fixed on the support frame. In an embodiment with bracket gussets 88 attached to the vibratory housing 74 adjacent the front end 80 and/or the rear end 82 of the base 78, the mid section 84 of the guide member 64 is positioned between an adjacent pair of bracket gussets to maintain the position of the vibratory housing laterally within the interior space 48.

As noted above, the vibratory housing 74 is permitted to move vertically relative to the support frame 34. At least one biasing member 92 is disposed between the support frame 34 and the vibratory mechanism 50. The at least one biasing member 92 may be attached to the underneath of the top plate 38 of the support frame 34 and to top and/or sides of the vibratory housing 74. The at least one biasing member 92 may be two or more separate biasing members. The biasing member 92 is configured to generate a down force on the vibratory mechanism 50 when in use. The biasing member is different from the rubber mounts used in the prior art, which are neutral when not deflected and provide a re-centering force dependent upon the direction of deflection of the vibratory housing. The biasing members 92 of the disclosure provide only down force.

Each biasing member 92 may include one or more of a spring, and/or a fluid cylinder including gas and/or hydraulic fluid generating the down force. The biasing member 92 may be replaced with biasing members with different spring values or rates to generate selected different amounts of down force. The biasing member 92 may, in an embodiment incorporating a coil spring alter the spring force value by compressing the spring, via, for example, a screw mechanism, as is well known. The biasing member 92 may be constructed to incorporate a variable spring rate, for example a progressive spring rate. Gas charged biasing members are progressive according to the Boyle's law.

In embodiments where the biasing member 92 includes a gaseous or liquid fluid, a source of fluid pressure 23, from an accumulator and/or a pump may be provided in communication with the vibratory plate compactor 20 so as to provide a fixed or changeable fluid pressure to generate a selected down force. In this manner, the force generated by each of the biasing members 92 may be maintained or changed according to operator preference or other specifications. For example, different work surfaces 21 may require different degrees of down force applied thereto to accomplish a desired compaction.

The at least one biasing member 92 generates a force between the support frame 34 and the vibratory mechanism 50. The force is directed generally downwardly and applied to the work surface by the skid base 54 of the vibratory mechanism 50. The amount of down force generated by the biasing member(s) 92 may be set or selected according to the number and configuration of biasing members provided to the vibratory plate compactor 20.

The total down force applied by the vibratory base 78 may be considered to include the force generated by the biasing member(s) 92. The effect of the down force and the periodic forces generated by the vibrations during operation of the vibratory mechanism 50 are applied to the work surface. Due to the construction of the vibratory plate compactor 20, the total down force is independent of the effect of the boom 12 of the work machine 10 and the support frame 34 because the vibratory base 78 only applies the force generated by the biasing member(s) 92. Accordingly, the selected forces generated by the vibratory plate compactor 20 are consistent and will produce a consistent compaction effect of the work surface 21.

As seen in FIG. 5, the vibratory plate compactor 20 is in an undeployed condition or state, where the vibratory housing 74 is not in contact with a work surface 21. The vibratory housing 74 may be considered to be suspended by the guide members 64 and the biasing members 92, which are in an extended state. The biasing members 92 and guide members 64 retain the vibratory housing 74 on the support frame 34. The guide members 64 guide the vibratory housing 74 through the vibratory housing range of motion through interaction with the guide opening 90 in the vibratory housing 74 bracket gussets 88.

As seen in FIG. 6, the vibratory plate compactor 20 is in a deployed condition or state, where the vibratory housing 74 is in contact with a work surface 21. The effect of bringing the vibratory plate compactor 20 into contact with the work surface 21 causes the vibratory housing 74 to be urged upwardly into the support frame 34 and causes the vibratory base 78 to align with the skid base 54 to the extent that the work surface permits. Bringing the vibratory plate compactor 20 into contact with the work surface 21 causes compression of the biasing members 92 and the generation of the selected or predetermined down force of the biasing members on the vibratory mechanism 50.

The vibratory plate compactor 20 may include one or more sensor 94 to monitor one or more of motion, force, and frequency and other aspects of the vibratory plate compactor. In one embodiment, the sensor 94 may be used in conjunction with an electronic controller 96 to determine operation of the vibratory plate compactor, including the determination of rebound force, which is useful to determine the compaction of the work surface 21. Generally, rebound force increases as a function of compaction. The determined rebound force may be used to determine when the vibratory plate compactor 20 has achieved a specified compaction of the work surface 21 and may be moved to a new location or whether the down force should be changed to increase the efficiency of the compaction process, for example by increasing or decreasing the down force generated by the biasing members 92.

In use, and referring to the above figures, the vibratory compactor 20 may be operating in one embodiment, according to the following. The work surface 21 is contacted with the vibratory mechanism 50 of the vibratory compactor 20 (FIG. 5) and then the support frame 34 of the vibratory compactor 20 is brought into contact with the work surface (FIG. 6) by lowering the boom 12 of the work machine 10 (FIG. 1). The act of contacting the work surface compresses the biasing member(s) 92 and thereby a selected down force is generated between the support frame and the vibratory housing and applied to the work surface. A fluctuating vertical force is generated with the vibratory mechanism 50 that in combination with the selected down force, causes compaction of the work surface 21. Further, the sensor 94 may sense a rebound force produced by the vibratory mechanism on the work surface. The controller 96 may determine a degree of compaction of the work surface 21 based on the sensed rebound force and one or both of the selected down force and time of contacting the work surface may be adjusted automatically or by an operator of the work machine 10 based on the determined degree of compaction.

INDUSTRIAL APPLICABILITY

The present disclosure is applicable to vibratory plate compactors and work machines that operate vibratory plate compactors. The vibratory plate compactors of the disclosure are configured to generate a selected down force that produces a consistent compaction effect on a work surface.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A vibratory compactor, comprising:

a support frame defining an interior space and including a base disposed at a lower end thereof configured to contact a work surface;

a guide member attached to the support frame;

a vibratory mechanism including a vibratory housing including:

a contact plate disposed on the vibratory housing, the contact plate configured to compact the work surface;

one or more excitation devices configured to vibrate the contact plate;

a guide opening formed through the vibratory housing, the guide opening configured to movably receive the guide member and configured to permit the vibratory mechanism vertical movement relative to the support frame; and at least one biasing member disposed between the support frame and the vibratory housing, the at least one biasing member generating a selected force between the support frame and the vibratory housing when the base of the support frame is in contact with the work surface.

2. The vibratory compactor of claim 1, wherein the selected force includes a down force.

3. The vibratory compactor of claim 2, wherein the at least one biasing member includes one or more of a spring, a gas and a hydraulic fluid.

4. The vibratory compactor of claim 3, wherein the selected down force of the at least one biasing member is adjustable.

5. The vibratory compactor of claim 1, wherein the guide member extends transversely across the interior space.

6. The vibratory compactor of claim 1, wherein the guide member is supported on the support frame by a resilient member.

7. The vibratory compactor of claim 6, wherein the guide member includes two or more spaced, horizontally extending rods.

8. The vibratory compactor of claim 7, wherein the vibratory housing includes vibratory mounting brackets, each of the vibratory mounting brackets including spaced gussets, each of the spaced gussets including one said guide opening.

9. The vibratory compactor of claim 8, wherein the vibratory mounting brackets interconnect the vibratory housing and the contact plate.

10. The vibratory compactor of claim 9, wherein each of spaced, horizontally extending rods include a midsection disposed between an adjacent pair of the spaced gussets, the mid section sized to maintain a lateral position of each of the spaced, horizontally extending rods.

11. The vibratory compactor of claim 1, wherein the base of the support frame includes a skid base.

12. The vibratory compactor of claim 11, wherein the skid base includes two or more skids.

13. The vibratory compactor of claim 1, wherein the excitation device includes one of a pump and an electric motor to operate the excitation device.

14. The vibratory compactor of claim 1, further comprising a sensor operatively connected to the vibratory mechanism and a controller in communication with the sensor to receive signals from the sensor indicative of motion of the vibratory mechanism.

15. The vibratory compactor of claim 14, wherein the controller is configured to determine a degree of compaction of the work surface.

16. A work machine, comprising the vibratory compactor of claim 1, attached to and operated by the work machine.

17. A method of operating a vibratory compactor, comprising:

contacting, with a vibratory mechanism of the vibratory compactor, a work surface;

contacting, with a support frame of the vibratory compactor, the work surface;

generating, with a biasing member, a selected down force between the support frame and the vibratory housing; and generating a fluctuating vertical force with the vibratory mechanism that in combination with the selected down force, causes compaction of the work surface.

18. The method of claim 17, further comprising:

sensing, with a sensor, a rebound force of the vibratory mechanism on the work surface;

determining, with a controller in communication with the sensor, a degree of compaction of the work surface based on the sensed rebound force; and adjusting one or both of the selected down force and time of contacting the work surface based on the determined degree of compaction.

19. The method of claim 17, wherein the biasing member is two or more biasing members.

20. The method of claim 19, wherein each of the two or more biasing members includes one or more of a spring, a gas, and a hydraulic fluid.

* * * * *